US005261622A

United States Patent [19]

Bolich

[11] Patent Number: 5,261,622

[45] Date of Patent: Nov. 16, 1993

[54] APPARATUS FOR PAYING OUT BISECTED INSULATION MATERIAL

[75] Inventor: Richard M. Bolich, Toledo, Ohio

[73] Assignee: Owens-Corning Fiberglas Technology Inc., Summit, Ill.

[21] Appl. No.: 783,486

[22] Filed: Oct. 28, 1991

[51] Int. Cl.[5] ..... B65H 16/08

[52] U.S. Cl. ..... 242/67.3 R; 242/68.7; 242/55.2

[58] Field of Search ..... 242/67.3 R, 55.2, 54 R, 242/68.7, 68, 129.5, 129.6, 130, 132, 134, 137, 138, 1, 18 DD, 65, 66, 47, 67.1 R, 67.5

[56] References Cited

U.S. PATENT DOCUMENTS

| | | | |
|---|---|---|---|
| 441,356 | 11/1890 | Cary . | |
| 1,829,727 | 11/1931 | Barrett | 242/67.3 R |
| 2,730,310 | 1/1956 | Schultz . | |
| 3,025,014 | 3/1962 | Casey | 242/67.3 R |
| 3,104,072 | 9/1963 | Doven et al. . | |
| 3,223,344 | 12/1965 | Weymouth . | |
| 3,955,772 | 5/1976 | Chisholm et al. . | |
| 4,168,038 | 9/1979 | Nims . | |
| 4,449,675 | 5/1984 | Parry . | |
| 4,492,345 | 1/1985 | Bakker . | |
| 4,512,530 | 4/1985 | Rauschert et al. . | |

*Primary Examiner*—Stanley N. Gilreath
*Attorney, Agent, or Firm*—Ted C. Gillespie

[57] ABSTRACT

Apparatus for paying out bisected insulation material includes a cradle for holding a supply roll of bisected insulation material, a rewind shaft for rerolling a second layer of the supply roll as a first layer of the supply roll is payed out, and mounting means for the rewind shaft adapted to enable the rewind shaft to move in a plane at an angle to the vertical as the relative sizes of the supply roll and the rewind roll change, where the angle is within the range of from about 25 to about 75 degrees from the vertical.

26 Claims, 2 Drawing Sheets

APPARATUS FOR PAYING OUT BISECTED INSULATION MATERIAL

TECHNICAL FIELD

This invention pertains to equipment for handling continuous strips of insulation material, such as continuous blankets of light density fiberglass insulation. More particularly, this invention pertains to unrolling a bisected insulation blanket where a first layer is payed out and a second layer is rewound to be payed out at a later time.

BACKGROUND ART

In the manufacture of insulation blankets of mineral fibers, such as glass fibers, it is sometimes economically efficient to produce the insulation material in a bisected form. Bisected insulation material is an insulation blanket which is slit horizontally as the blanket travels along a horizontal conveyor. The upper and lower layers remain juxtaposed, and are rolled up and packaged for shipping to a fabrication customer or other ultimate insulation user. The insulation fabricator or user will use the bisected insulation rolls to insulate such items as appliances, flexible insulation ducts, and manufactured housing. Typically this insulation material has a density within the range of from about 0.3 to about 1.0 pounds per cubic foot (pcf), and a tensile strength within the range of from about 10 to about 30 pounds per six inches of width of a two inch thick R-6 insulation product having a density of 0.8 pounds pcf.

The insulation fabricator or end user needs a simple and convenient way to pay out the bisected insulation roll so that the fabricator can use one of the layers while rewinding the other layer for use at a later time. Existing machines for paying out bisected insulation material are generally deficient in several respects. First, such machines are usually complex to operate and expensive to build. Often they are motorized, requiring an operator as well as a fabricator to receive the payed out insulation material. Another deficiency of many payout machines is that no means is provided for preventing telescoping of the rewind roll as the second layer is being rewound while the first layer is being payed out. Telescoping causes tearing or other degradation of the insulation material. Also, a common deficiency of such machines, particularly if the machines are motorized, is that the machines tend to break the insulation material, which has a relatively low tensile strength. Finally, for machines which rely on a friction drive to drive the rewind roll with the rotation of the supply roll, the weight of the rewind roll as it reaches its maximum size tends to crush or cause pinching and tearoff of the supply roll as it reaches its smallest diameter during the payout.

There is a need for a simple-to-operate, low cost, payout machine for bisected insulation material which avoids the problems of the prior art machines.

DISCLOSURE OF THE INVENTION

There has now been developed an insulation payout machine for bisected insulation material which uses a mounting means, such as a pair of opposed channels, for guiding a rewind shaft, where the channels are oriented in a plane at an angle to the vertical. The rewind roll rolls up the second layer of the insulation material while the first layer is payed out. As the insulation material is payed out, the rewind roll becomes increasingly larger and the original roll or supply roll becomes increasingly smaller. As this happens, the ends of the rewind shaft slide downwardly in the pair of opposed channels so that as the rewind roll reaches its maximum diameter it is not directly above the supply roll.

The apparatus of the invention requires no motors, and can be driven by the manual pulling force of a single person (fabricator). The pulling of the first layer of the insulation rotates the supply roll, and the rewind roll, which rests on the supply roll by the force of gravity, will be rotated in a counter-direction in order to wind the second layer of insulation material into the rewind roll.

According to this invention, there is provided apparatus for paying out bisected insulation material having first and second layers, comprising a cradle for holding a supply roll of bisected insulation material; a rewind shaft for rerolling a second layer of the supply roll as the first layer of the supply roll is payed out; and, mounting means for the rewind shaft adapted to enable the rewind shaft to move in a plane at an angle to the vertical as the relative sizes of the supply roll and the rewind roll change, where the angle is within the range of from about 25 to about 25 degrees from the vertical. In a preferred embodiment of the invention, the plane is at an angle to the vertical within the range of from about 35 to about 55 degrees.

In a specific embodiment of the invention, the mounting means comprises a pair of opposed channels. Preferably, the rewind shaft is mounted so that it always stays in a horizontal orientation.

In yet another embodiment of the invention, the rewind shaft is supported on an inner shaft, the inner shaft being concentrically inward of the rewind shaft. The rewind shaft being freely rotatable about the inner shaft, and the ends of the inner shaft being mounted for movement within the channels. In a preferred embodiment of the invention, the ends of the inner shaft are mounted in the channel with a rack and pinion assembly.

In yet another specific embodiment of the invention the lower end of the mounting means or channel extends across the axial center line of the cradle so that as the supply roll becomes increasingly smaller and the rewind roll becomes larger, the supply roll will be pushed to one side of the cradle and not be directly underneath the rewind roll.

In another specific embodiment of the invention, the apparatus is provided with adjustable side guides for providing alignment of the rewind roll as it becomes increasingly larger. Preferably, the side guides are adjustable to accommodate different widths of insulation material. The side guides also can act to guide the payout of the insulation material.

BEST MODE FOR CARRYING OUT THE INVENTION

Figure 1:
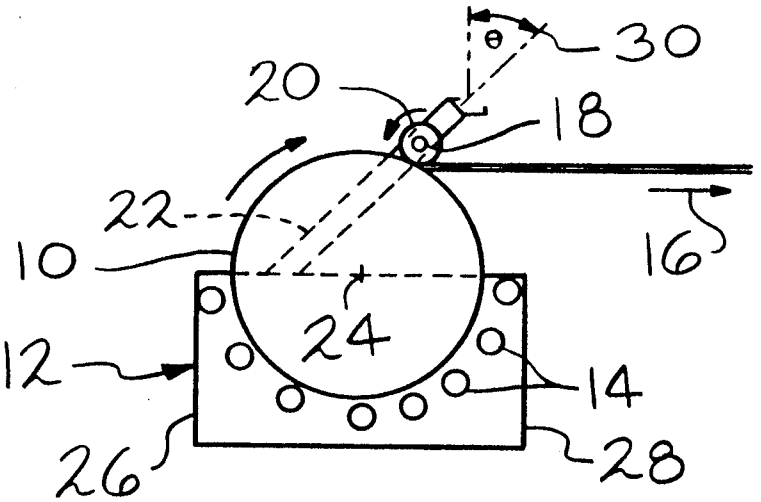
FIG. 1 is a schematic view in elevation of the apparatus for paying out the bisected insulation material according to the principles of the invention, where the supply roll is nearly at its initial size and the rewind roll is just beginning to be formed on the rewind shaft.

This invention will be described in terms of a bisected glass fiber light density insulation blanket, but it is to be understood that the insulation material could be other insulation material, such as mineral fibers, and the insulation material could also be of heavier density, such as greater than about one pound pcf. Also, the material could be trisected.

As shown in FIGS. 1 through 4, supply roll 10 of bisected insulation material is resting in cradle 12. The cradle can be any suitable means for holding the supply roll and enabling it to rotate freely in order to pay out the insulation material. Preferably, the cradle is adapted with rollers 14 to facilitate rotation of the supply roll.

The cradle, being a generally concave member in order to conform with the shape of the supply roll, has axial centerline 24, which generally coincides with the initial axis of rotation of the supply roll as it first begins to be unwound. The axial centerline is generally equidistant from the feed side 26 and the payout side 28 of the cradle. The payout side of the cradles is the side from which the insulation material is dispensed or payed out by the fabricator for use ni the fabrication process. The feed side is the opposite side of the cradle, and is the side of the cradle to which a subsequent supply roll is added to the cradle after all of the insulation of the original supply roll is payed out by the fabricator.

As the first layer 16 of the insulation material is payed out from the supply roll, the remaining insulation material is wound about rewind shaft 18 to form rewind roll 20. The ends of the rewind shaft are mounted for movement within a mounting means such as channels 22. The mounting means can be any suitable means for guiding the ends of the rewind shaft to enable the movement of the rewind shaft as the relative sizes of the supply roll and rewind roll change.

Rather than being mounted in a vertical position, the channel is mounted at an angle $\theta$ to the vertical. The angle e is within the range of from about 25 to about 75 degrees. Preferably, the angle $\theta$ is within the range of from about 35 to about 55 degrees. In the most preferred embodiment, the angle $\theta$ is 45 degrees. Thus, it can be seen that the rewind shaft is mounted in the channel to be moveable in plane 30 which is at the angle $\theta$ to the vertical.

Figure 2:
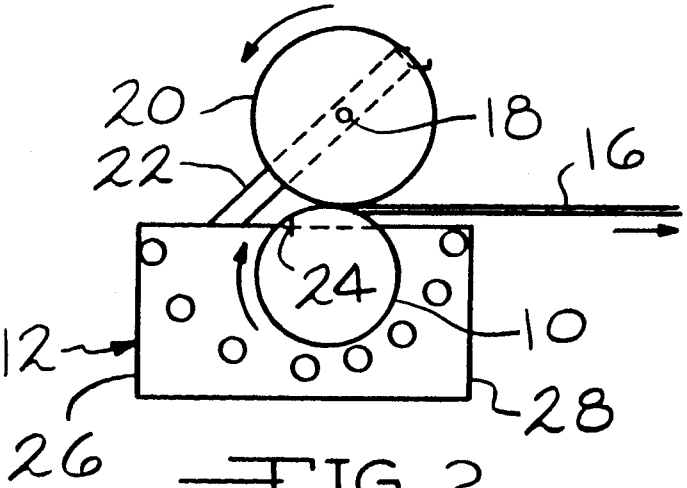
FIG. 2 is a schematic view in elevation of the apparatus of FIG. 1 where the rewind roll and the supply roll are of nearly equal size.

As shown more particularly in FIG. 2, as the supply roll is payed out, the size of the rewind roll eventually exceeds the size of the supply roll.

Figure 3:
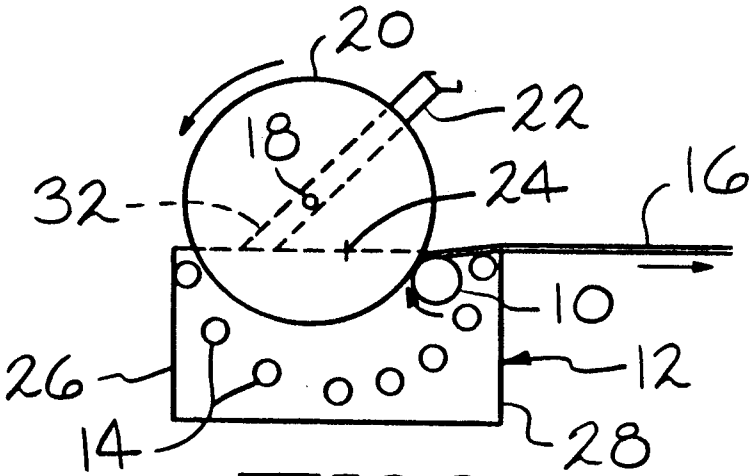
FIG. 3 is a schematic view in elevation of the apparatus of FIG. 1, showing the rewind roll nearly in its largest condition and the supply roll nearly depleted.

As shown more particularly in FIG. 3, the rewind shaft slides or moves down the channel to the lower end 32 of the channel as the rewind roll approaches its largest size. As the rewind roll becomes increasingly larger, the rewind shaft travels or is moved toward the feed side of the cradle since the lower end of the channel extends across the axial centerline of the cradle. As the rewind roll moves toward the feed side of the cradle, the supply roll moves toward the payout side of the cradle, even though the rewind roll and the supply roll are still maintaining friction contact as the first layer of insulation material is payed out. Since the supply roll is not directly beneath the rewind roll, there is reduced jamming or crushing of the supply roll during the latter stages of its payout.

Figure 4:
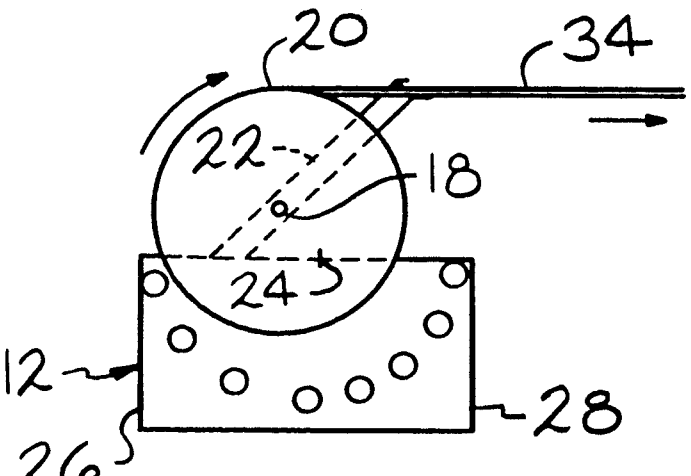
FIG. 4 is a schematic view in elevation of the apparatus of FIG. 1 showing the paying out of the second layer of insulation material from the rewind roll.

As shown more particularly in FIG. 4, when the supply roll is exhausted, the second layer 34 of the insulation material can be payed out from the rewind roll.

Figure 5:
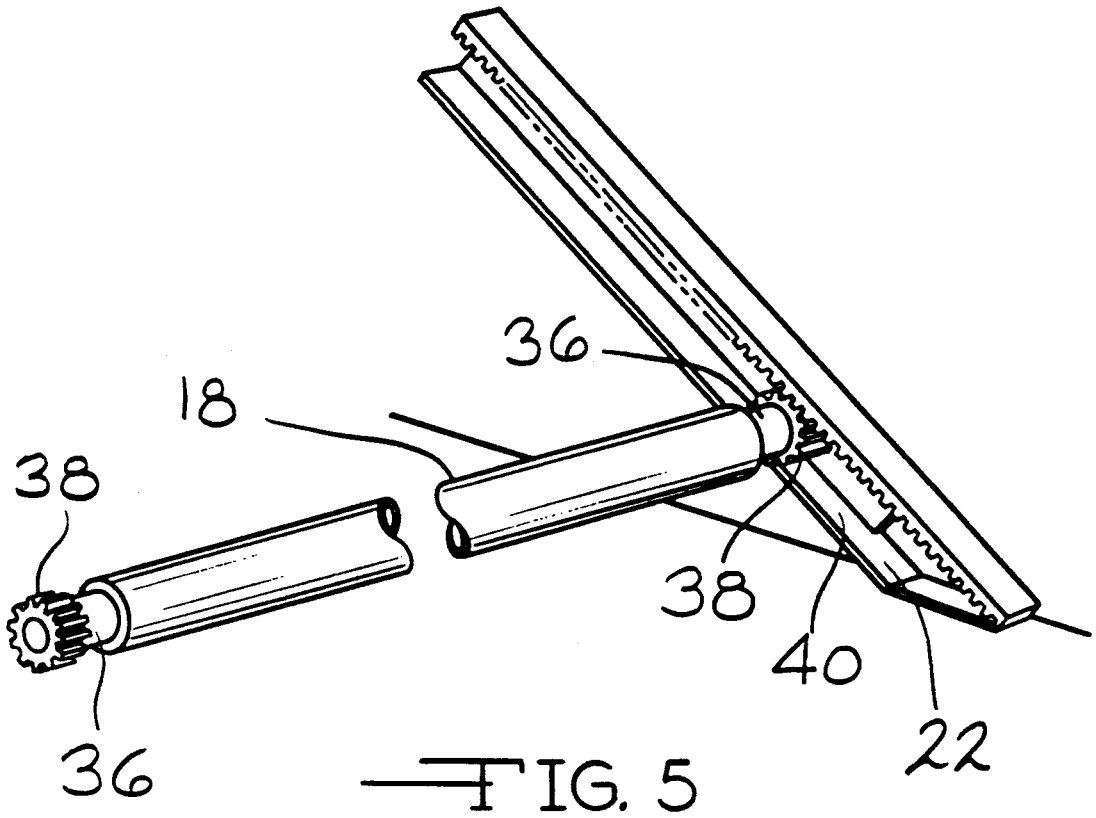
FIG. 5 is a schematic perspective view of one of the opposed channels, the rewind shaft, and the inner shaft with the rack and pinion gear assembly according to the principles of the invention.

As shown in FIG. 5, the rewind shaft is mounted for free rotation about inner shaft 36 by any suitable means, such as bearings, not shown. The inner shaft has at its ends pinion gears 38 which coincide with rack gears 40 mounted in each channel. With both pinion gears positioned within the opposed channels, the rewind shaft can travel up and down the channel, but the rewind shaft will always be maintained in a horizontal orientation since both rack and pinion gears must be operated simultaneously. It is to be understood that means, such as a tracking device, not shown, could be provided, for adjusting the rack and pinion gear assembly, or the orientation or height of the channel, in order to modify the orientation or level of the rewind shaft as desired.

As shown in FIG. 3, the cradle can be adapted with a greater number of rollers 14 on the payout end of the cradle in order to accommodate the smaller size of the supply roll near the end of its payout.

Figure 6:
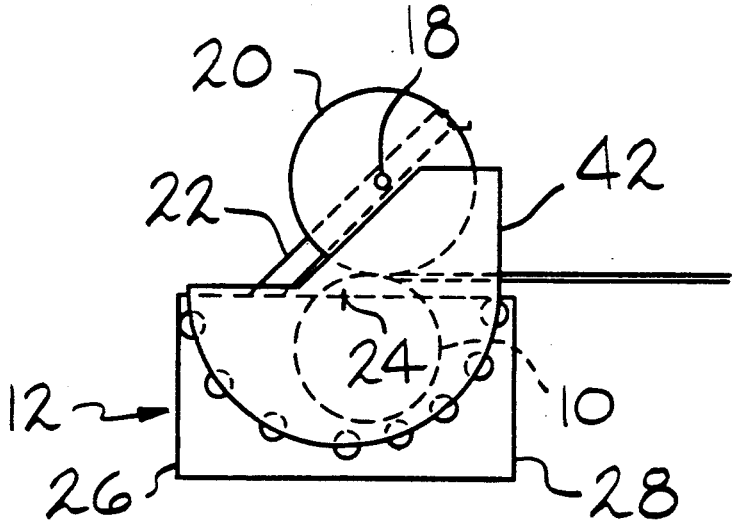
FIG. 6 is a schematic view in elevation of the apparatus as shown in FIG. 2, but also showing the side guide for guiding the material being rewound onto the rewind shaft.

As shown in FIG. 6, the apparatus can be adapted with side guide 42 for contacting and guiding the second layer of insulation material as it is being rewound onto the rewind shaft in order to prevent telescoping. Preferably, the side guide is mounted for movement along the axial centerline to accommodate different widths of insulation rolls. The side guides extend above the cradle because they are needed to shape the rewind roll which is formed above the cradle.

In operation, the insulation fabricator places a bisected insulation roll into the cradle, threads the second or outer layer around the rewind shaft to begin building the rewind roll, and begins to pull out the first layer of the insulation material. After the entire first layer of insulation material is pulled out, the insulation fabricator then pays out the second layer of insulation material from the rewind roll, as shown in Figure 4. All of the pulling can be done by hand.

It will be evident from the foregoing that various modifications can be made to this invention. Such, however, are considered as being within the scope of the invention.

INDUSTRIAL APPLICABILITY

This invention will be found to be useful in using bisected insulation blankets of mineral fibers.

I claim:

1. Apparatus for paying out bisected insulation material having first and second layers comprising: insulation material;

a rewind shaft for rerolling a second layer of the supply roll as a first layer of the supply roll is payed out, the rewind shaft being supported on an inner shaft, the inner shaft being concentrically inward of the rewind shaft, and the rewind shaft being freely rotatable about the inner shaft; and a pair of opposed channels for mounting the rewind shaft to enable the rewind shaft to move in a plane at an angle to the vertical within the range of from about 25 to about 75 degrees, where the ends of the inner shaft are mounted for movement within the channels.

2. The apparatus of claim 1 in which the rewind shaft is mounted so that it always stays in a horizontal orientation.

3. The apparatus of claim 2 in which the ends of the inner shaft are mounted in the channels with a rack and pinion assembly.

4. Apparatus for paying out bisected insulation material having first and second layers comprising:

a cradle for holding a supply roll of bisected insulation material, the cradle comprising a plurality of rollers mounted for rotation to support the supply roll and to enable the supply roll to freely rotate;

a rewind shaft for rerolling a second layer of the supply roll as a first layer of the supply roll is payed out;

a pair of opposed channels for mounting the rewind shaft, the channels being positioned to enable the rewind shaft to move in a plane at an angle to the vertical within the range of from about 25 to about 75 degrees; and an inner shaft which is concentrically inward of the rewind shaft and about which the rewind shaft is freely rotatable, the ends of the inner shaft being mounted with a rack and pinion assembly for movement within the channels.

5. The apparatus of claim 4 in which the rewind shaft is mounted so that it always stays in a horizontal orientation.

6. The apparatus of claim 5 comprising adjustable side guides for providing alignment of the rewind roll as it becomes increasingly larger.

7. The apparatus of claim 6 in which said plane is at an angle to the vertical within the range of from about 35 to about 55 degrees.

8. In combination, a supply roll of bisected insulation material having first and second layers, apparatus for paying out the supply roll and winding up the second layer as a rewind roll, and said rewind roll, where the combination further comprises:

a cradle for holding the supply roll of bisected insulation material;

a rewind shaft for rerolling the second layer of the supply roll as the first layer of the supply roll is payed out; and mounting means for the rewind shaft adapted to enable the rewind shaft to move in a plane at an angle to the vertical as the relative sizes of the supply roll and the rewind roll change, where the angle is within the range of from about 25 to about 75 degrees from the vertical, and where the rewind shaft is supported on an inner shaft, the inner shaft being concentrically inward of the rewind shaft, the rewind shaft being freely rotatable about the inner shaft, and the ends of the inner shaft being mounted for movement within the mounting means.

9. The combination of claim 8 in which the mounting means comprises a pair of opposed channels.

10. The combination of claim 9 in which the rewind shaft is mounted so that it always stays in a horizontal orientation.

11. The combination of claim 10 in which the ends of the inner shaft are mounted in the channels with a rack and pinion assembly.

12. The combination of claim 8 in which the cradle has an axial centerline which approximates the axis of rotation of the supply roll as it first begins to be unwound, the mounting means has two ends, a lower end and an upper end, the cradle has a payout side and a feed side, and the lower end of the mounting means is positioned on the feed side of the axial centerline of the cradle so that as the supply roll becomes increasingly smaller and the rewind roll becomes larger, the rewind roll will move toward the feed side of the cradle and the supply roll will be pushed to the payout side of the cradle.

13. The combination of claim 12 in which the cradle comprises a plurality of rollers mounted for rotation to support the supply roll and to enable the supply roll to freely rotate.

14. The combination of claim 13 in which the payout side of the cradle has rollers more closely spaced than the rollers on the feed side.

15. The combination of claim 8 comprising adjustable side guides which extend above the axial centerline of the cradle for providing alignment of the rewind roll.

16. The combination of claim 8 in which said plane is at an angle to the vertical within the range of from about 35 to about 55 degrees.

17. In combination, a supply roll of bisected insulation material having first and second layers, apparatus for paying out the supply roll and winding up the second layer as a rewind roll, and said rewind roll, where the combination further a cradle for holding the supply roll of bisected insulation material, the cradle comprising a plurality of rollers mounted for rotation to rotatably support the supply roll;

a rewind shaft for rerolling the second layer of the supply roll as the first layer of the supply roll is payed out;

a pair of opposed channels for the rewind shaft, the channels being positioned to enable the rewind shaft to move in a plane at an angle to the vertical as the relative sizes of the supply roll and the rewind roll change, where the angle is within the range of from about 25 to about 75 degrees; and an inner shaft which is concentrically inward of the rewind shaft and about which the rewind shaft is freely rotatable, the ends of the inner shaft being mounted with a rack and pinion assembly for movement within the channels.

18. The combination of claim 17 in which the rewind shaft is mounted so that it always stays in a horizontal orientation.

19. The combination of claim 18 in which the cradle has an axial centerline which approximates the axis of rotation of the supply roll as it first begins to be unwound, the mounting means has two ends, a lower end and an upper end, the cradle has a payout side and a feed side, and the lower end of the mounting means is positioned on the feed side of the axial centerline of the cradle and the upper end of the mounting means is positioned on the payout side of the axial centerline of the cradle so that as the supply roll becomes increasingly smaller and the rewind roll becomes larger, the rewind roll will move toward the feed side of the cradle and the supply roll will be pushed to the payout side of the cradle.

20. The combination of claim 19 comprising adjustable side guides for providing alignment of the rewind roll as it becomes increasingly larger.

21. The combination of claim 20 in which said plane is at an angle to the vertical within the range of from about 35 to about 55 degrees.

22. In combination, a supply roll of bisected insulation material having first and second layers, apparatus for payout out the supply roll and winding up the second layer as a rewind roll, and said rewind roll, where the combination further comprises:

a cradle for holding the supply roll of bisected insulation material, the cradle having an axial centerline which approximates the axis of rotation of the supply roll as it first begins to be unwound;

a rewind shaft for rerolling the second layer of the supply roll as the first layer of the supply roll is payed out; and mounting means for the rewind shaft adapted to enable the rewind shaft to move in a plane at an angle to the vertical as the relative sizes of the supply roll and the rewind roll change, where the angle is within the range of from about 25 to about 75 degrees from the vertical, where the mounting means has two ends, a lower end and an upper end, the cradle has a payout side and a feed side, and the lower end of the mounting means is positioned on the feed side of the axial centerline of the cradle and the upper end of the mounting means is positioned on the payout side of the axial centerline of the cradle so that as the becomes larger, the rewind roll will move toward the feed side of the cradle and the supply roll will be pushed to the payout side of the cradle.

23. The combination of claim 22 in which the mounting means comprises a pair of opposed channels.

24. The combination of claim 23 in which the rewind shaft is mounted so that it always stays in a horizontal orientation.

25. The combination of claim 24 in which the rewind shaft is supported on an inner shaft, the inner shaft being concentrically inward of the rewind shaft, the rewind shaft being freely rotatable about the inner shaft, and the ends of the inner shaft being mounted for movement within the channels.

26. The combination of claim 25 in which the ends of the inner shaft are mounted in the channels with a rack and pinion assembly.

* * * * *